US006985003B2

(12) United States Patent
Li et al.

(10) Patent No.: US 6,985,003 B2
(45) Date of Patent: Jan. 10, 2006

(54) CIRCUIT AND METHOD FOR TESTING A FLAT PANEL DISPLAY

(75) Inventors: Ying-Hsin Li, Kaohsiung (TW); An Shih, Changhua (TW)

(73) Assignee: Toppoly Optoelectronics Corp., Chunan (TW)

( * ) Notice: Subject to any disclaimer, the term of this patent is extended or adjusted under 35 U.S.C. 154(b) by 0 days.

(21) Appl. No.: 10/888,557

(22) Filed: Jul. 9, 2004

(65) Prior Publication Data

US 2005/0030058 A1 Feb. 10, 2005

(30) Foreign Application Priority Data

Jul. 11, 2003 (TW) ..... 92118975 A

(51) Int. Cl.
*G01R 31/00* (2006.01)

(52) U.S. Cl. ..... 324/770; 349/190; 349/192

(58) Field of Classification Search ..... 324/770, 324/158.1; 345/3, 50, 87, 98, 100, 204; 349/49, 349/41, 54, 192, 152, 40

See application file for complete search history.

(56) References Cited

U.S. PATENT DOCUMENTS

| | | | | |
|---|---|---|---|---|
| 5,113,134 | A * | 5/1992 | Plus et al. | 324/770 |
| 5,204,617 | A * | 4/1993 | Kumagai | 324/770 |
| 6,362,643 | B1 * | 3/2002 | Kim | 324/770 |
| 6,630,840 | B2 * | 10/2003 | Tomita | 324/765 |
| 6,794,892 | B2 * | 9/2004 | Matsueda | 324/770 |
| 6,815,975 | B2 * | 11/2004 | Nara et al. | 324/770 |
| 6,850,085 | B2 * | 2/2005 | Sakaguchi et al. | 324/765 |

* cited by examiner

*Primary Examiner*—Vinh Nguyen
*Assistant Examiner*—Jimmy Nguyen
(74) *Attorney, Agent, or Firm*—Liu & Liu

(57) ABSTRACT

A testing circuit and a testing method for a flat panel display. The testing circuit is provided to each input terminal of data lines of a data driving circuit, which is integrated into the flat panel display. The testing circuit is for testing performance of a pixel as well as performance of the data driving circuit in the flat panel display.

20 Claims, 2 Drawing Sheets

CIRCUIT AND METHOD FOR TESTING A FLAT PANEL DISPLAY

CROSS-REFERENCE TO RELATED APPLICATION

This application claims the priority benefit of Taiwan application serial no. 92118975, filed on Jul. 11, 2003.

BACKGROUND OF THE INVENTION

1. Field of the Invention

The present invention relates to a testing circuit and a testing method thereof, and more particularly, to a testing circuit and an operation method thereof for a flat panel display.

2. Description of the Related Art

Generally, the means for Flat Panel Display comprises Liquid Crystal Display (LCD), Field Emission Display (FED), Organic Light Emitting Diode (OLED), and Plasma Display Panel (PDP). Since the characteristics of thinness, lightness, flexibility, and compatibility to portable wireless communication and network technologies for present generation and beyond, LCD is undoubtedly the most prevailing flat panel display among all.

Material wise, Thin Film Transistor (TFT) LCD is further classified into at least two categories: amorphous-silicon (a-Si) LCD and poly-silicon (poly-Si) LCD, where Low Temperature Poly-Silicon (LTPS) LCD has been successfully developed. Since LTPS TFT provides higher mobility than a-Si LCD, it serves as an active element of the LCD, and it can be integrated with peripheral circuits onto a glass substrate, i.e., generally known as System on glass (SoG). In testing the flat panel display with conventional testing method, external probe serves to input a digital switching signal to each data line and each scanning line, so as to diagnose each TFT of a pixel.

However, as SoG technique develops, the conventional method becomes ineffective for testing the flat panel display for the data driving circuit has been integrated into the flat panel display. The reason is that on an display panel integrated with data driving circuit, a digital signal feeding the input pin is converted to an analog signal by a Digital-Analog Converter (DAC) as well as by an analog driving circuit, so as to drive the pixels on the panel. Therefore, it is an issue to diagnose the converter circuits on a display panel with data line driving circuit integrated. Furthermore, as the flat panel display is assembled, the external testing probe has no access to the data line and scanning line on the flat panel display, not allowing testing of the performance of the pixels on the flat panel display as succeeding process is completed.

SUMMARY OF THE INVENTION

In the light of the above problems, it is a primary object for the present invention to provide a circuit and a method for testing a flat panel display. In the present invention, a testing circuit is integrated in the flat panel display, which can perform testing of the performance of the pixels of the flat panel display without the use of test probes. The test circuit of the present invention is attached to the input terminal of each data line of an integrated data driving circuit of the flat display panel, so as to test performance of corresponding pixels on the flat panel display as well as performance of the data driving circuit.

In order to achieve the foregoing and other objects, a testing circuit of the flat panel display is provided. The flat panel display comprises a gate driving circuit, a data driving circuit, a plurality of scanning lines, a plurality of data lines, a plurality of pixels, and a plurality of testing circuits. Each of the testing circuits corresponds to one of the data lines. When testing the pixels on one of the data lines, usually the gate driving circuit is firstly set at a first voltage level, and the pixels on one of the data lines are biased to a positive voltage. Then the gate driving circuit is set at a second voltage level, and the pixels on one of the data lines are grounded. Each of the testing circuits comprises a comparator and a register, wherein the comparator has a first input terminal, a second input terminal, and an output terminal. The first input terminal receives a pixel voltage sent from one of the pixels corresponding to one of the data lines as the gate driving circuit is at the first voltage level, and the second input terminal receives a reference voltage. The comparator compares the pixel voltage with the reference voltage, and outputs a comparison signal from output terminal therein. The register is electrically coupled to the comparator for receiving the comparison signal and generating a status signal according to the comparison signal, so as to determine the performance of each one of the pixels.

In accordance with the preferred embodiment of the present invention, the status signal indicates each one of the pixels as functioning or damaged according to the pixel voltage identical to or different from the reference voltage. It is noted that when the gate driving circuit is set to the second voltage level and the pixels on one of the data lines are grounded, it is to discharge the parasitic capacitor thereof.

The present invention further provides a testing circuit for the flat panel display. The flat panel display comprises a gate driving circuit, a data driving circuit, a plurality of scanning lines, a plurality of data lines, a plurality of pixels, and a plurality of testing circuits. Wherein each of the testing circuits corresponds to one of the data lines. A data driving circuit for propagating a comparison bit so as to generate an analog signal to a data line via the data driving circuit and the DAC that are coupled in series. Moreover, each testing circuit comprises a comparator and a register. The comparator has a first input terminal, a second input terminal, and an output terminal, where the first input terminal is for receiving the output analog signal, and the second input terminal is for receiving a reference voltage signal corresponding to the comparison bit. Whereas the comparator is for comparing the output analog signal with the reference voltage signal as well as generating the comparison signal via the output terminal thereof. The register is electrically coupled to the comparator to receive the comparison signal, and outputs a status signal according to the comparison signal so as to diagnose the performance of the data driving circuit.

In accordance with the preferred embodiment of the present invention, the status signal indicates that the data driving circuit is damaged as the output analog signal is different from the reference voltage. However the status signal indicates that the data driving circuit is functioning as the output analog signal is identical to the reference voltage.

The present invention further provides a testing method for the flat panel display. The flat panel display comprises a gate driving circuit, a data driving circuit, a plurality of scanning lines, a plurality of data lines, a plurality of pixels, and a plurality of testing circuits. Each of the testing circuits corresponds to one of the data lines. The present testing method comprises the steps that are described as follows. Firstly, setting the gate driving circuit on a first voltage level and providing a positive voltage to the pixels on one of the data lines. Secondly, setting the gate driving circuit on a second voltage level and connecting the pixels on one of the data lines to ground. Further, one of the pixels on one of the data lines providing a pixel voltage and receiving a reference voltage as the gate driving circuit is at the first voltage level. Ultimately, comparing the pixel voltage with the reference voltage so as to generate a comparison signal as well as a status signal to diagnose the performance of the pixel.

The present invention further provides a testing method for the testing circuit of the flat panel display. The flat panel display comprises a gate driving circuit, a data driving circuit, a plurality of scanning lines, a plurality of data lines, a plurality of pixels, and a plurality of testing circuits, where each of the testing circuits corresponds to one of the data lines. The present testing method comprises the steps described as follows. Firstly, the data driving circuit propagating a comparison bit so as to generate an analog signal via the data driving circuit as well as the DAC. Secondly, receiving the output analog signal and receiving a reference voltage signal corresponding to the comparison bit. Further, comparing the output analog signal with the reference voltage signal so as to output a comparison signal. Ultimately, receiving the comparison signal and generating a status signal according to the comparison signal so as to diagnose the performance of the data driving circuit.

In summary, the present invention provides an extra testing circuit to each input terminal of data lines of a data driving circuit which is integrated into the flat panel display, so as to test the performance of a pixel as well as the performance of the data driving circuit in the flat panel display.

BRIEF DESCRIPTION OF THE DRAWINGS

The accompanying drawings are included to provide a further understanding of the invention, and are incorporated in and constitute a part of this specification. The drawings illustrate embodiments of the invention, and together with the description, serve to explain the principles of the invention.

DESCRIPTION OF THE PREFERRED EMBODIMENTS

Figure 1:
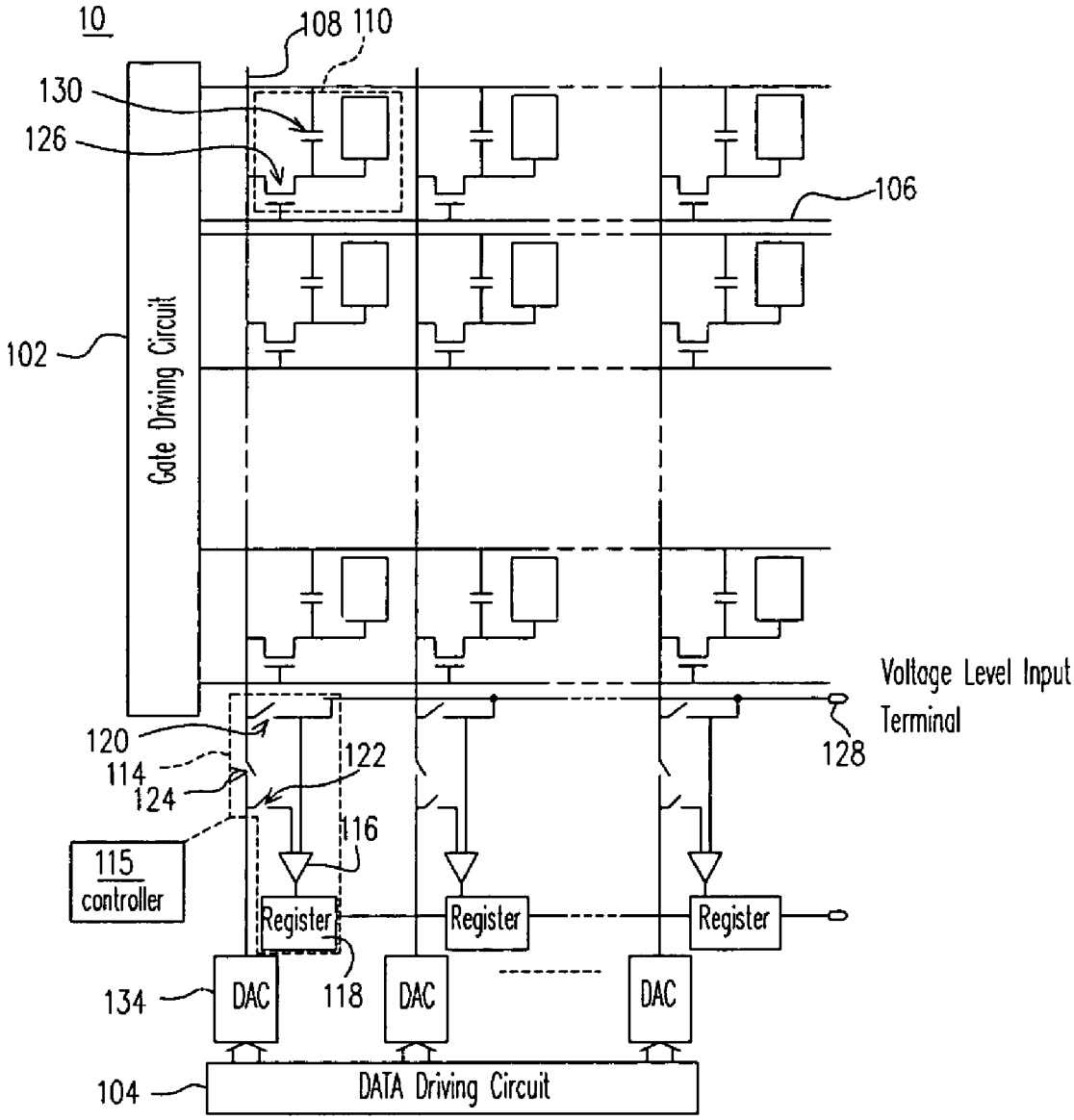
FIG. 1 is a schematic view of a flat panel display with a testing circuit of a preferred embodiment according to the present invention.

Referring to FIG. 1, it is a schematic view of a flat panel display with a testing circuit of a preferred embodiment according to the present invention. The flat panel display may be a LTPS (Low Temperature Poly-Silicon) LCD (Liquid Crystal Display). As shown in FIG. 1, the flat panel display 10 comprises a gate driving circuit 102, a data driving circuit 104, a plurality of scanning lines 106, a plurality of data lines 108, a plurality of pixels 110, and a plurality of testing circuits 114, each associated with one data line. The testing circuit 114 is exemplified herein for description. The testing circuit 114 corresponds to the data line 108. In addition, the testing circuit 114 comprises a comparator 116, a register 118, a first switch 120, a second switch 122, and a third switch 124, for example controlled by a controller 115, whereas the testing circuit 114 is for testing the performance of the pixels 110 and the data driving circuit 104.

The method of the testing circuit 114 for testing the performance of the pixels 110 is described below. As the pixels 110 is under testing, the switch 120 is closed, for example under a control by the controller 115 according to the desired operation condition, whereas the switch 122 and switch 124 are open, and the gate driving circuit 102 is set at a first voltage level, which is a high voltage level in a preferred embodiment. The high voltage level is selectively pumped to the scanning line 106 by the gate driving circuit 102 so as to turn on the transistor 126 for the corresponding one pixel 110 with respect to the gate driving circuit 102. Then, a positive voltage (e.g. 3.8 V) is supplied to the voltage level input terminal 128, and the positive voltage drives the pixel 110 through the switch 120 and data line 108, where a capacitor 130 in the pixel 110 stores the high voltage as a pixel voltage. Then, the gate driving circuit 102 is set at a second voltage level, which is a low voltage level in a preferred embodiment. Notice that the voltage levels of the first and second voltage levels mentioned above are different from each other and are adjustable upon design. When the gate driving circuit 102 is at the low voltage level, the low voltage level selectively drives the scanning line 106, and thus the transistor 126 is turned off. A grounded voltage (0V) is then drawn to the voltage level input terminal 128 so as to discharge the parasitic capacitor on the data line 108.

Then, the switch 120 is set open, whereas the switch 122 and switch 124 are set closed. The gate driving circuit 102 is operated at a high voltage level so that to drive the scanning line 106 at the high voltage level thereby. Meanwhile the transistor 126 is turned on, such that the pixel charge stored in the capacitor 130 is released to the data line 108 to pull up the voltage level on the data line 108 so as to drive one input terminal of the comparator 116. Meanwhile, a reference voltage (e.g. 0.1V) is provided to the voltage level input terminal 128 so as to drive the other input terminal of the comparator 116. Thereby, the comparator 116 compares the pixel voltage with the reference voltage and generates a comparison signal accordingly. The register 118 receives the comparison signal and generates a status signal according to the comparison signal, hence the performance of the pixel 110 is diagnosed thereby. The status signal indicates that the pixel 110 is damaged if the pixel voltage is different from the reference voltage, whereas the status signal indicates that the pixel 110 is good if the pixel voltage is identical to the reference voltage. For example, if a normal pixel voltage released to the data line 108 is 0V and the reference voltage is 0.1 V, the comparator 116 outputs "1" to the register 118, so that the register 118 outputs a status signal which indicates that the pixel 110 is damaged.

The testing method that the testing circuit 114 diagnoses performance of the data driving circuit 104 is described. For testing the data driving circuit 104, the switch 120 and switch 124 are firstly opened whereas the switch 122 is closed. The control on the switches 120, 122, 124 of the testing circuit 114 can be for example controlled by the controller 115 based on the desired testing procedure. However, the switches can be turned on/off according to the desired test condition by a control method associating with the necessary hardware, and should be understood by the ordinary skilled artisan. The data driving circuit 104 propagates a comparison bit (e.g. 111111) to the DAC 134 so as to generate an output analog signal to one input terminal of the comparator 116. Then, a reference voltage signal (e.g. 111111=3.8 V) corresponding to the comparison bit is provided to the voltage level input terminal 128, and it is then sent to the other input terminal of the comparator 116.

Thereafter, the comparator 116 compares the output analog signal with the reference voltage signal so as to generate a comparison signal from the output terminal. The register 118 receives the comparison signal from the output of the comparator 116 and propagates a status signal according to the comparison signal, so as to diagnose the performance of the data driving circuit 104. The status signal indicates that the data driving circuit 104 is damaged if the output analog signal is different from the reference voltage signal, yet the status signal indicates that the data driving circuit 104 is functioning if the output analog signal is identical to the reference voltage signal. For example, when the output analog signal is 0V and the reference voltage signal is 3.8 V, the comparator 116 generates a "1" to the register 118, so that the register 118 generates the status signal indicating the data driving circuit 104 being damaged. On the contrary, when the output analog signal is 3.8 V and the reference voltage signal is 3.8 V, the output terminal of the comparator 116 generates a "0" to the register 118, such that the register 118 generates the status signal indicating the data driving circuit 104 being functioning.

In summary, the present invention provides an extra testing circuit to each input terminal of data lines of a data driving circuit which is integrated into the flat panel display, so as to test the performance of a corresponding pixel as well as the performance of the data driving circuit in the flat panel display.

Figure 2:
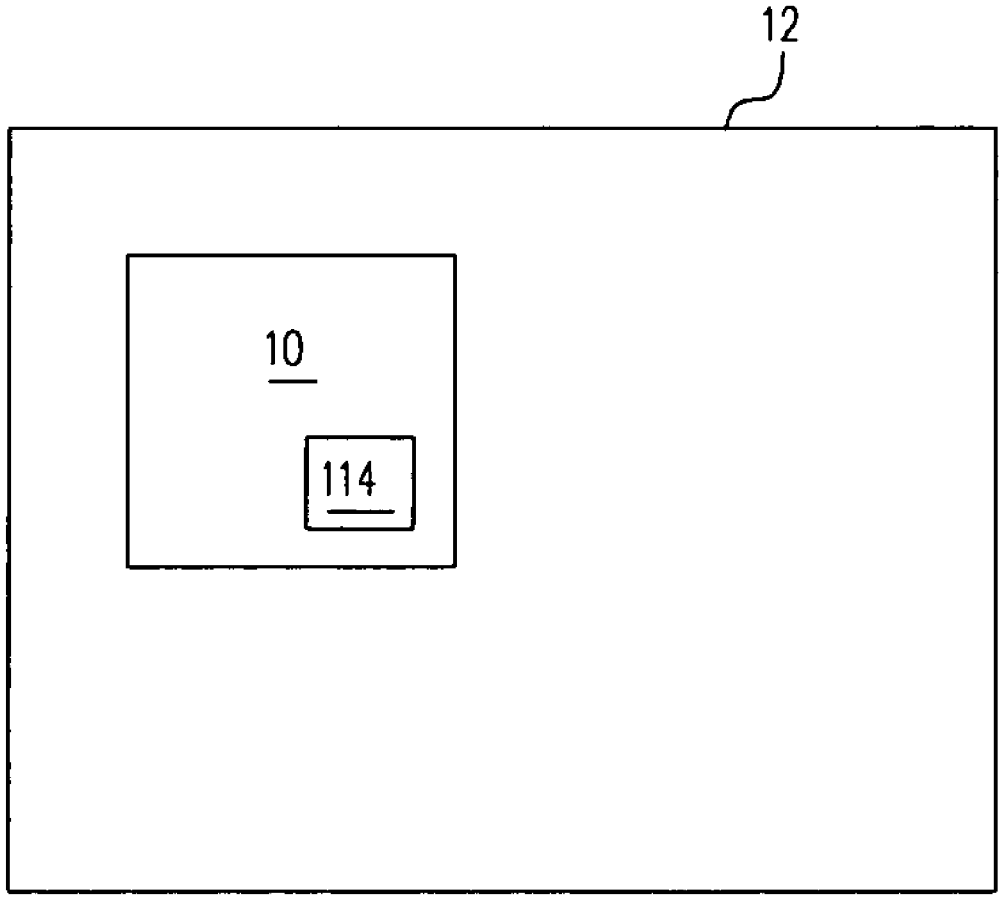
FIG. 2 is a schematic view of an electronic device comprising a flat panel display having the inventive testing circuit.

FIG. 2 is a schematic view of an electronic device comprising a flat panel display having the inventive testing circuit. In FIG. 2, the flat panel 10 can be implemented into an electronic device 12, such as a flat panel TV, machine with display, or mobile phone, via for example a suitable interface or any known coupling manner.

Although the invention has been described with reference to a particular embodiment thereof, it will be apparent to one of the ordinary skill in the art that modifications to the described embodiment may be made without departing from the spirit of the invention. Accordingly, the scope of the invention will be defined by the attached claims not by the above detailed description.

What is claimed is:

1. A testing circuit, integrated into a flat panel display comprising a plurality of pixels, a gate driving circuit, a data driving circuit, a plurality of scanning lines for selecting a desired pixel out of the pixels, and a plurality of data lines, for the interested pixel corresponding to the data line being tested by the testing circuit by setting the gate driving circuit to a first voltage level that biases the interested pixels to a positive voltage, and setting the gate driving circuit to a second voltage level in order to draw the desired pixels to ground, the testing circuit comprising:

a comparator, having a first input terminal, a second input terminal, and an output terminal, for comparing a pixel voltage with a reference voltage so as to output a comparison signal via the output terminal, wherein the first input terminal receives the pixel voltage sent from the interested pixel as the gate driving circuit is set to the first voltage level, the second input terminal receives the reference voltage; and a registering circuit, being electrically coupled to the comparator, for receiving the comparison signal and generating a status signal according to the comparison signal so as to determine the performance of the interested pixel.

2. The testing circuit of claim 1, wherein the status signal indicates that the interested pixel is functioning if the pixel voltage is identical to the reference voltage.

3. The testing circuit of claim 1, wherein the status signal indicates that the interested pixel is damaged if the pixel voltage is different from the reference voltage.

4. The testing circuit of claim 1, wherein the plurality of interested pixels on data line are drawn to ground so as to discharge a parasitic capacitor on the data line as the gate driving circuit is set to the second voltage level.

5. The testing circuit of claim 1, wherein the first voltage level is higher than the second voltage level.

6. A testing circuit, integrated into a flat panel display comprising a plurality of pixels, a gate driving circuit, a data driving circuit, a plurality of scanning lines, and a plurality of data lines, for diagnosing the performance of the data driving circuit by propagating a comparison bit to the data driving circuit in order to obtain an output analog signal from a DAC coupled to the data driving circuit in series, the testing circuit comprising:

a comparator, having a first input terminal, a second input terminal, and an output terminal, for generating a comparison signal from the DAC by comparing the output analog signal with a reference voltage, wherein the first input terminal receives the output analog signal and the second input terminal receives the reference voltage corresponding to the comparison bit; and a registering circuit, being electrically coupled to the comparator for receiving the comparison signal and generating a status signal according to the comparison signal.

7. The testing circuit of claim 6, wherein the status signal indicates that the data driving circuit is damaged if the output analog signal is different from the reference voltage.

8. The testing circuit of claim 6, wherein the status signal indicates that the data driving circuit is functioning if the output analog signal is identical to the reference voltage.

9. A testing method, for a flat panel display integrating a testing circuit, the flat panel display comprising a plurality of pixels, a gate driving circuit, a data driving circuit, a plurality of scanning lines for selecting a desired pixel from the pixels, and a plurality of data lines, the testing circuit corresponding to the data line and the interested pixel where performance of the interested pixel is diagnosed thereby, the testing method comprising:

setting the gate driving circuit to a first voltage level, and biasing the interested pixel on the data line to a positive voltage;

setting the gate driving circuit to a second voltage level, and drawing the interested pixel on the data line to ground;

receiving a pixel voltage sent from the interested pixel on the data line as the gate driving circuit is at the first voltage level;

receiving a reference voltage;

comparing the pixel voltage with the reference voltage and generating a comparison signal thereby; and receiving the comparison signal and generating a status signal thereby.

10. The testing method for the flat panel display of claim 9, wherein the interested pixel are drawn to ground so as to discharge a parasitic capacitor corresponding to the data line as the gate driving circuit is set at the second voltage level.

11. The testing method for the flat panel display of claim 9, wherein the first voltage level is higher than the second voltage level.

12. A testing method, for a flat panel display integrating a testing circuit, the flat panel display comprising a plurality of pixels, a gate driving circuit, a data driving circuit, a plurality of scanning lines for selecting an interested pixel out of the pixels, and a plurality of data lines, the testing circuits corresponding to the data line and the interested pixel where performance of the data driving circuit is diagnosed thereby, the testing method comprising:

propagating a comparison bit to the data driving circuit and generating an output analog signal via the data driving circuit and a DAC that are in series connection;

receiving the output analog signal;

receiving a reference voltage signal corresponding to the comparison bit;

comparing the output analog signal with the reference voltage signal and generating a comparison signal; and receiving the comparison signal and generating a status signal according to the comparison signal, so as to diagnose the performance of the data driving circuit.

13. The testing method for the flat panel display of claim 12, wherein the status signal indicates that the data driving circuit is damaged if the output analog signal is different from the reference voltage.

14. The testing method for the flat panel display of claim 12, wherein the status signal indicates that the data driving circuit is functioning if the output analog signal is identical to the reference voltage.

15. A testing circuit for testing performance of at least one of a data driving circuit and an array of display elements in a flat panel display device, comprising:

a source of a reference voltage;

a comparator operatively coupled to the source of reference voltage and at least one of the data driving circuit and the array of display elements, and:

(a) if testing the display elements, comparing a first voltage relating to a status of a desired display element to the reference voltage, and outputting a first signal representative of a status of performance of the desired display element; and (b) if testing the data driving circuit, comparing a second voltage relating to a status of the data driving circuit, and outputting a second signal representative of a status of performance of the data driving circuit.

16. The testing circuit of claim 15, further comprising a registering circuit, coupled to the comparator for producing a status signal to indicate a test result.

17. A flat panel display, comprising:

an array of display elements;

a gate driving circuit and a data driving circuit operative coupled to the array of display elements; and a testing circuit as in claim 15 integrated within the flat panel display, which is operatively coupled to and configured for testing at least one of the data driving circuit and the array of display elements.

18. The flat panel display as in claim 17, wherein the testing circuit is operatively coupled to and configured for testing both the data driving circuit and the array of display elements.

19. The flat panel display as in claim 17, wherein the testing circuit is configured to selectively test the data driving circuit and the array of display elements in response to control by a controller.

20. An electronic device, comprising:

a flat panel display as in claim 17; and an interface receiving and providing image data to the display device.

* * * * *